United States Patent [19]

Freeman et al.

[11] 4,017,384

[45] Apr. 12, 1977

[54] PNEUMATIC BYPASS SYSTEM FOR AIR WASH SEPARATORS

[75] Inventors: Ardee H. Freeman; Bruce H. Berger, Jr., both of Granger, Ind.

[73] Assignee: Wheelabrator-Frye, Inc., Mishawaka, Ind.

[22] Filed: Nov. 3, 1975

[21] Appl. No.: 628,540

[52] U.S. Cl. ..... 209/149; 209/135

[51] Int. Cl.[2] ..... B07B 11/06

[58] Field of Search ..... 209/32–35, 209/133–135, 146, 154, 489, 491, 149, 496, 497, 499, 240, 246, 258; 222/52, 56, 335; 51/263, 264; 73/37; 214/17 CA

[56] References Cited

UNITED STATES PATENTS

| | | | |
|---|---|---|---|
| 3,005,547 | 10/1961 | Freeman | 209/32 |
| 3,632,019 | 1/1971 | Harm | 222/56 |

FOREIGN PATENTS OR APPLICATIONS

| | | | |
|---|---|---|---|
| 559,062 | 9/1932 | Germany | 209/496 |

*Primary Examiner*—Frank W. Lutter
*Assistant Examiner*—Ralph J. Hill
*Attorney, Agent, or Firm*—McDougall, Hersh & Scott

[57] ABSTRACT

A pneumatic bypass system for air wash separators is disclosed. The system detects a surge or overflow of sand passing into an air wash separator by means of a pressure probe located in the vicinity of the separator's swinging baffle. When a sand surge is detected, a pressure drop is produced in the probe tube operating a pressure switch and solenoid valve for actuating a pneumatic cylinder and piston assembly for opening the swinging baffle to permit the sand surge to pass the separator lip.

6 Claims, 5 Drawing Figures

FIG. 1
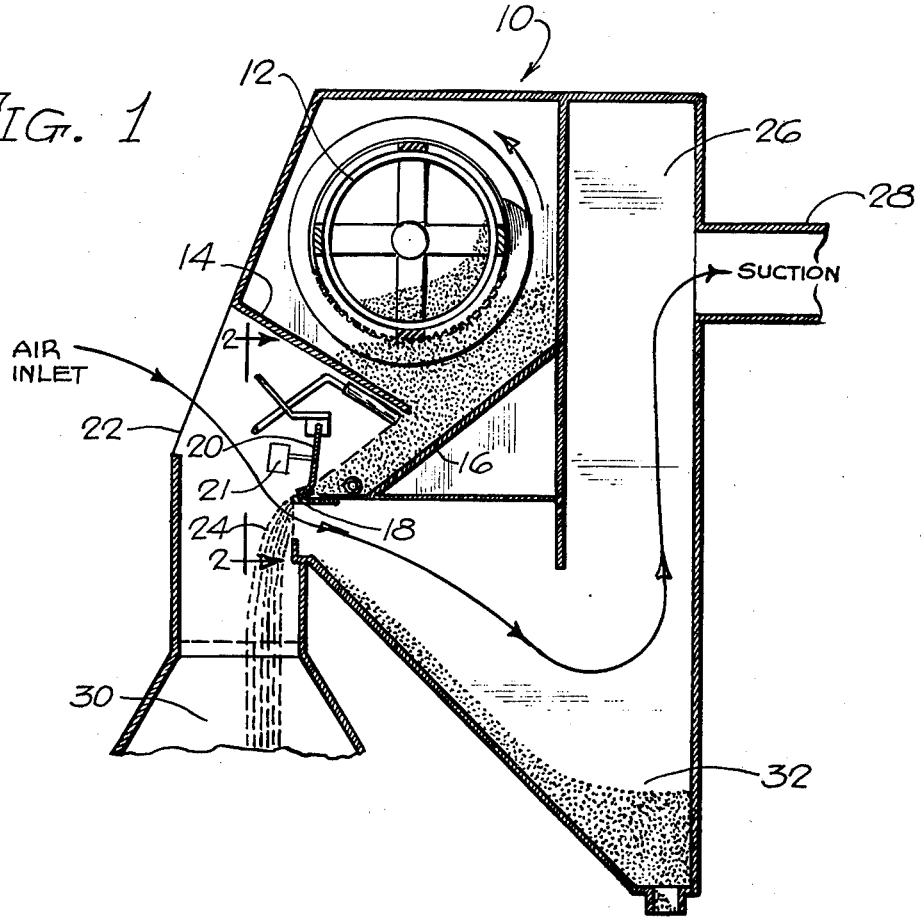
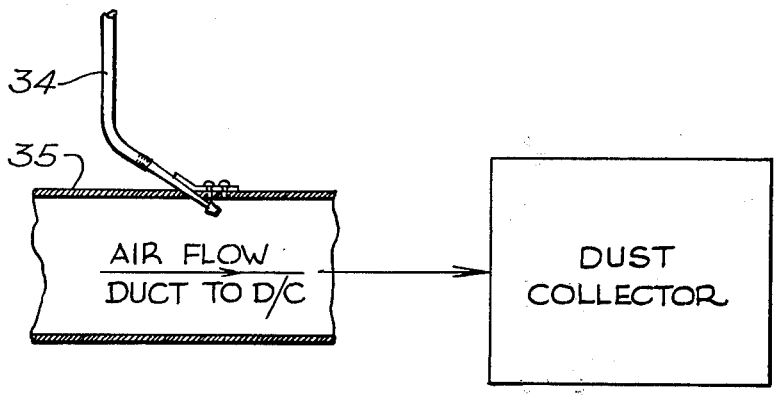
FIG. 5

FIG. 2
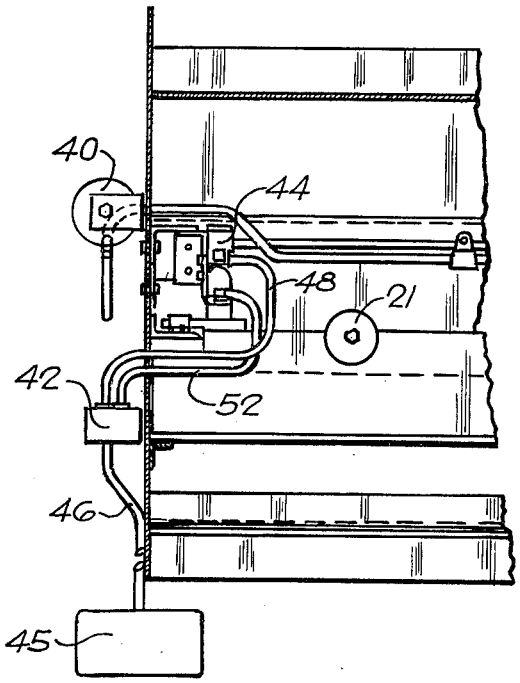
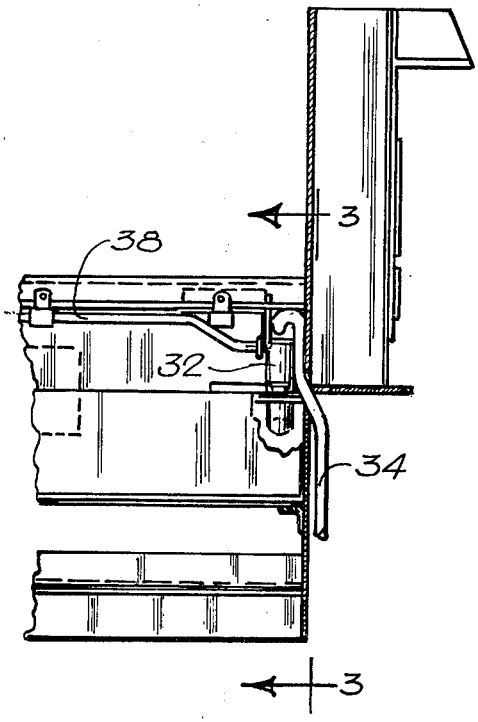
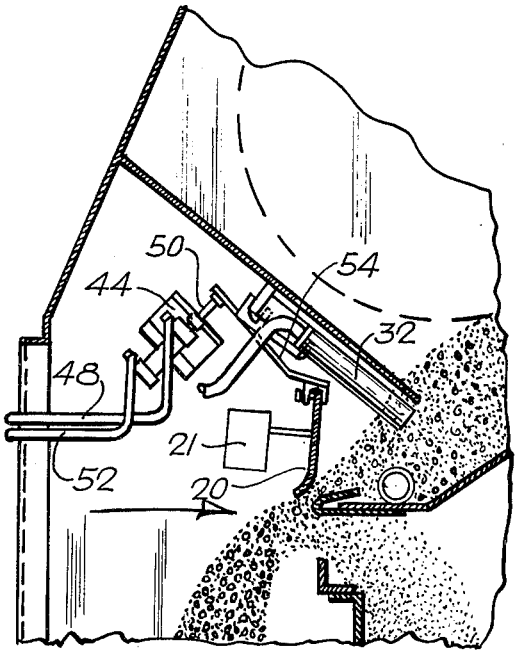
FIG. 4
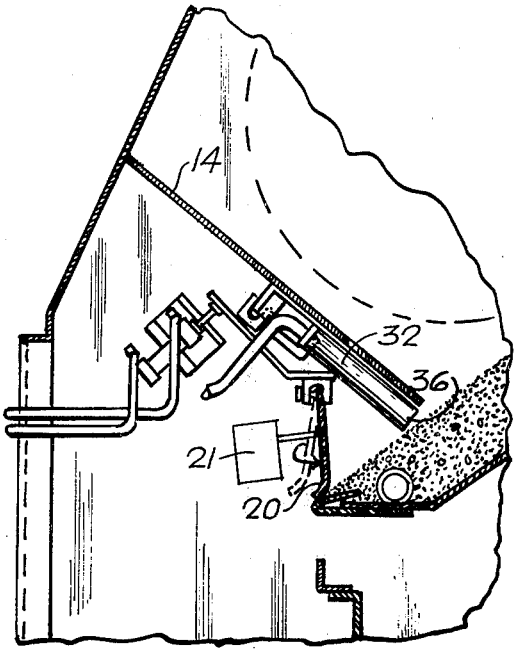
FIG. 3

PNEUMATIC BYPASS SYSTEM FOR AIR WASH SEPARATORS

BACKGROUND OF THE INVENTION

This invention relates to the field of particulate separation. In particular it relates to the field of air wash separators and related devices utilized for separating particulates, such as abrasives, from sand, refuse and other debris encountered in molding, surface treatment, and like operations. For example, an air wash separator is often employed for separating reuseable abrasives, such as steel shot, grit, or the like, from sand, dust and fines.

An air wash separator, speaking generaly, is a device which passes material to be separated over a lip in a state of essentially, gravity free fall and then blows a curtain of air past the free falling material. The abrasives, being of a higher density than the debris and sand, are deflected less than the debris and sand by the air curtain. Thus, a first receptacle provided directly under the falling stream will receive mostly abrasive particles while the lighter elements will be deflected out of the downward path into a second receptacle provided therefor. The present invention relates to an improvement for air wash separators to deal with the problem of operation during periods when abrasive content is absent from the air wash separator and there is essentially pure sand passing through the device. For a more complete discussion of air wash separators and their applicaion, reference is made to U.S. Pat. No. 3,005,547 incorporated thereby.

In an air wash separator, such as is disclosed in the above referenced U.S. Pat. sand and abrasive to be separated pass over a lip when the quantity of material builds up sufficiently to offset a counter-weighed swinging baffle. The problem solved by the present invention is that due to the weight difference in pure sand from that of a sand abrasive mixture, when pure sand is present the swingable baffle does not operate properly and the air wash separator tends to overflow or back up with sand.

In prior systems for dealing with the sand problem a mechanical trip box system has been utilized to open the swinging baffle during periods when sand surges are passing through the separator. The trip box system was deficient in that it is difficult to properly balance so that the swinging baffle will return to its normal position when the sand surge condition has ended. Further, the trip box was not able to trip far enough to drain or spill out all sand. Thus, it was necessary to add drain holes.

It is accordingly an object of the present invention to provide an improved sensing system for an air wash separator which will open a swinging baffle to permit a sand surge to pass through the device.

It is another object of the present invention to provide a system which will provide a positive and automatic opening of the swinging baffle when a sand surge is present and return the swinging baffle to its normal functioning position after the sand surge has passed.

It is a further object of the present invention to provide a system for handling sand surges in an air wash separator which does not require that the swinging baffle be balanced for sand flow conditions.

It is a further object of the present invention to provide a device which will pass sand surges through the separator in order to remove much of the sand on its first pass through the separator without the need for recycling it to wait for a mixture of abrasives thereby eliminating a need for a bypass system.

Other objects and advantages of the invention will become apparent from the concluding portion of the specification.

BRIEF DESCRIPTION OF THE DRAWINGS

FIG. 1 is a side elevational view through a section of an air wash separator having a pneumatic bypass system according to the present invention.

FIG. 2 is a front elevational view of an air wash separator having a pneumatic bypass system according to the present invention.

FIG. 3 is a view similar to FIG. 1 taken along the lines 3—3 of FIG. 2.

FIG. 4 is a view similar to FIG. 3 illustrating operation of the device to trip the swinging baffle.

FIG. 5 is a schematic of the air system for the invention.

DETAILED DESCRIPTION

Referring now to FIG. 1, the components of an air wash separator are illustrated. Abrasive and sand which are to be separated are supplied to an air wash separator 10 by means of a screw feed conveyor 12. As the material is discharged from the screw feed conveyor, it strikes a fixed baffle 14 which extends in a generally downward direction. The baffle 14 ends at a position short of the supporting structure 16 for the separator lip 18. Thus, after the material impinges upon the fixed baffle 14 it slids downwardly on surface 16 to the edge of lip 18. A swinging baffle 20 is provided to prevent flow of abrasive and sand over the edge of lip 18 until there is a sufficient amount of material to form a full width curtain and thereby provide effective separation when the air strikes the falling curtain of material.

Air is drawn in through an inlet port 22 across the falling particulate 24 when the swinging baffle 20 is open and is sucked outwardly through an exhaust plenum 26 via a source of suction connected to pipe 28. As indicated schematically in FIG. 1, the abrasive passes into a first chamber 30 while the lighter sand and fines are blown by the air stream into a second chamber 32. Further details on the construction and operation of an air wash separator are provided in the aforementioned U.S. Pat. No. 3,005,547 incorporated hereby.

As explained earlier in the background section of this specification, in order to insure proper operation of the air wash separator the swinging baffle 20 is provided with a set of counter weights 21 such that the baffle 20 will not open and permit particulate to fall from the lip 18 until a sufficient quantity of sand and abrasive is present. A problem encountered with this mode of operation is that when the baffle counter weights are properly set for an abrasive and sand mixture, they will not open for sand surges, i.e., quantities of sand passed through the device which do not contain a mixture of abrasive. This is a frequent occurrence in an air wash separating system and thus it is a problem which requires serious attention in order to assure a satisfactory operation.

The present invention provides a sensing system which detects the presence of a sand surge and opens the swinging baffle 20 to permit the sand to pass over lip 18.

Referring to FIGS. 2 through 5, the details of the present invention are more clearly illustrated. The pneumatic system employs a probe tube 32 attached to and positioned beneath the fixed baffle 14. The probe tube is connected via flexible conduit 34 to the dust collector duct of the air wash separator (FIG. 5). As is well known in the art, air wash separators employ a dust collector and an air flow to the dust collector is provided. Conduit 34 taps into the duct 35 going to the dust collector and, as indicated, thereby creates a low pressure or suction in the tube 34.

During normal operation (FIG. 3) of the air wash separator the probe tube 32 has its open end 36 unblocked, so that air can pass into the probe tube and out the flexible tube 34 to the dust collector. Thus, the probe tube remains substantially at atmospheric pressure. The probe tube 32 is positioned on the underside of the fixed baffle 14 a sufficient distance from the surface 16 to avoid becoming imbedded in the abrasive sand mixture during normal operation of the separator. Operation of the swinging baffle 20 is determined by the setting of the counter weights 21 which setting can be changed by varying the distance the weight 21 is maintained away from the baffle 20. In the present invention, due to the presence of the pneumatic system, the swinging baffle is accurately balanced and adjusted for abrasive flow. It will not open from the pressure of sand, in the absence of abrasive nor will it open under the condition when there is a high proportion of sand to abrasive.

The probe tube 32 is located at the overflow end of the air wash separator. As has been stated, the open end of the probe 36 is not buried in the abrasive during normal operation and therefore the pressure inside the probe is at atmospheric pressure. Connected to and communicating with the interior of the probe is a second flexible conduit 38 which is connected to a pressure switch 40 mounted at a convenient location on the air wash separator device. The pressure switch can be a standard item as, for example, a Dwyer pressure switch, such as Dwyer Model No. 1823-1. Electrically connected to the pressure switch is a solenoid valve 42. Valve 42 controls the operation of a pneumatic cylinder 44 by controlling a source of compressed air 45 provided to operate cylinder 44. Pneumatic cylinder 44 is a two-way cylinder whereby air pressure on line 48 operates to retract a piston 50 while pressure on line 52 operates to extend piston 50 (FIG. 4).

Positioned adjacent the pneumatic cylinder 44 in alignment with the piston 50 is a trip plate 54. It will be apparent from FIG. 4 that extension of piston 50 is effective for striking the trip plate 54 while retraction of piston 50 permits the trip plate to reset. The trip plate 54 is connected to swinging baffle 20 such that when the trip plate is struck by the piston the swinging baffle is forced open to allow a sand surge to pass under the swinging baffle and over the separator lip 18. Operation of the pneumatic cylinder 44 is controlled by the probe tube 32 in the following manner. When a sand surge occurs (FIG. 4) the probe tube 32 becomes buried in the surge due to the abnormally high level of sand in the separator. When the probe tube is buried air can no longer enter through the open end 36. Due to the suction on the probe tube from line 34 a pressure drop is produced in the probe tube. This suction or pressure drop is communicated via conduit 38 to the pressure switch 40 which detects the pressure drop. When a pressure drop occurs, the pressure switch produces an electrical signal for activating the solenoid valve 42 which in turn actuates pneumatic cylinder 44 to extend the piston 50 and strike the trip plate 54. The swinging baffle 20 is then opened to permit the sand surge to pass over the lip and down into the air stream. The air cylinder position can be set as necessary to open the swinging baffle after a preset amount of excess sand buildup. When the overflow condition ceases, the end of the probe tube will again be open to the atmosphere increasing the pressure in line 38, deactivating pressure switch 40. In turn this causes the pneumatic cylinder 44 to retract the piston 50 allowing the swinging baffle to function in its normal manner against the weight of an abrasive sand mixture as determined by the setting on the counter weights 21. Further, sand surges will repeat the cycle just described as soon as the probe tube is again buried in a sand buildup.

It will be apparent that the difference in weight of sand as compared to abrasive is significant enough that when the swinging baffle 20 is balanced to open for abrasive flow it will not open from the pressure of only sand or under conditions when a high proportion of sand is present as compared to the percentage of abrasive. As indicated in FIG. 3, after the sand surge has passed and piston 44 retracts, the trip plate 54 resets to its initial position and the counter weighted baffle 20 is free to swing and operate in response to abrasive impinging thereon in a normal manner.

While I have shown and described embodiments of this invention in some detail, it will be understood that this description and illustrations are offered merely by way of example and that the invention is to be limited in scope only by the appended claims.

I claim:

1. In an air wash separator for separating a mixture of lighter particles from denser particles including means for passing air through the separator and means for feeding said mixture to the air passing through the separator, the means for feeding including a separator lip over which said mixture passes a swinging baffle controlling passage of particles over said lip, a counter balance for adjusting the operation of said baffle, the improvement comprising:

a surge bypass system including:

a. pneumatic means for sensing lighter particle overflow in said feed means, b. trip means attached to said swinging baffle for opening said baffle when actuated;

c. a two-way pneumatic cylinder having an extensible piston, said piston actuating said trip means when extended; and d. valve means responsive to said pneumatic means for controlling operation of said cylinder to extend and retract said piston.

2. The system according to claim 1 wherein said baffle includes means for adjusting said baffle to open, under normal operating conditions, only for a mixture of particulate contaning substantial quantities of said denser particles

3. The system according to claim 1 wherein said pneumatic means includes:

a. a probe tube open at one end and connected to a source of vacuum, said open end positioned in sufficient proximity to said lip so that an overflow of lighter particles will bury said open end;

b. switch means for detecting pressure changes and producing a signal for controlling said valve means;

c. a conduit communicating the interior of said probe tube to said switch means whereby as the open end of said probe becomes buried or uncovered a pressure change is produced which is detected by said switch means.

4. The system according to claim 3 further including a dust collector means for receiving air which has passed through the separator and wherein said source of vacuum is derived from said dust collector.

5. The system according to claim 1 wherein said valve means includes a solenoid valve.

6. The system according to claim 1 wherein said trip means includes a trip plate attached to said swinging baffle, said baffle being pivoted to an open condition by movement of said trip plate to a trip position and maintained in its normal operating position when said trip plate is in a normal position.

* * * * *